US010231589B2

(12) United States Patent
Bian et al.

(10) Patent No.: US 10,231,589 B2
(45) Date of Patent: Mar. 19, 2019

(54) HOSE SUPPORT MECHANISM FOR VACUUM CLEANER

(71) Applicant: SUZHOU CLEVA ELECTRIC APPLIANCE CO., LTD., Suzhou, Jiangsu Province (CN)

(72) Inventors: Xiaoxian Bian, Jiangsu (CN); Jiangping Zhu, Jiangsu (CN); Haiping Liu, Jiangsu (CN); Min Liu, Jiangsu (CN); Zhenyu Xing, Jiangsu (CN)

(73) Assignee: Suzhou Cleva Electric Appliance Co., Ltd., Suzhou (CN)

( * ) Notice: Subject to any disclaimer, the term of this patent is extended or adjusted under 35 U.S.C. 154(b) by 600 days.

(21) Appl. No.: 14/895,273

(22) PCT Filed: Jun. 4, 2014

(86) PCT No.: PCT/CN2014/079138

§ 371 (c)(1),
(2) Date: Dec. 2, 2015

(87) PCT Pub. No.: WO2014/194820

PCT Pub. Date: Dec. 11, 2014

(65) Prior Publication Data

US 2016/0120384 A1 May 5, 2016

(30) Foreign Application Priority Data

Jun. 4, 2013 (CN) ..... 2013 1 0216972
Nov. 28, 2013 (CN) ..... 2013 1 0611730

(51) Int. Cl.

| | |
|---|---|
| ***A47L 9/00*** | (2006.01) |
| ***A47L 9/04*** | (2006.01) |
| ***A47L 9/24*** | (2006.01) |

(52) U.S. Cl.
CPC ..... *A47L 9/248* (2013.01); *A47L 9/00* (2013.01); *A47L 9/0036* (2013.01); *A47L 9/24* (2013.01)

(58) Field of Classification Search
CPC ..... A47L 9/248; A47L 9/0036; A47L 9/24
See application file for complete search history.

(56) References Cited

U.S. PATENT DOCUMENTS

2012/0222260 A1 9/2012 Conrad

FOREIGN PATENT DOCUMENTS

CN 201542559 8/2010
CN 202568077 12/2012
(Continued)

OTHER PUBLICATIONS

International Search Report for International Application No. PCT/CN2014/079138, dated Sep. 12, 2014.

*Primary Examiner* — Michael D Jennings
(74) *Attorney, Agent, or Firm* — JK Intellectual Property Law, PA

(57) ABSTRACT

A hose support mechanism for a vacuum cleaner including a machine body includes at least one elastic support for supporting a hose, wherein the elastic support can elastically deform to mutually buckle with or separate from the machine body. The hose support mechanism can be assembled and disassembled conveniently without using other tools, and can be adapted for hoses with different hose diameters. When the vacuum cleaner is provided with hoses with different hose diameters, there is no need to redesign the hose support mechanism, thereby enhancing the generality of the vacuum cleaner.

5 Claims, 10 Drawing Sheets

(56) References Cited

FOREIGN PATENT DOCUMENTS

| | | |
|---|---|---|
| CN | 203328634 | 12/2013 |
| CN | 103654627 | 3/2014 |
| CN | 203591223 | 5/2014 |

HOSE SUPPORT MECHANISM FOR VACUUM CLEANER

CROSS-REFERENCE TO RELATED APPLICATIONS

This application is a national stage of International Application No. PCT/CN2014/079138, filed Jun. 4, 2014, and claims benefit of Chinese Patent Applications No. CN 201310611730.0, filed Nov. 28, 2013 and CN 201310216972.X, filed Jun. 4, 2013 all of which are incorporated by reference herein.

TECHNICAL FIELD

The present invention relates to a vacuum cleaner, specifically to a hose support mechanism for the vacuum cleaner.

BACKGROUND

Vacuum cleaners (also called suction cleaners herein) are widely used to clean many kinds of places. The suction cleaner is generally provided with a bendable and flexible hose. Because the hose is long, when the user needs to fold the hose after using the suction cleaner, generally the hose is hung or wound on the suction cleaner. As a result, the suction cleaner is required to have a mechanism which can fix and release the hose quickly. Preferably, the mechanism can be disassembled conveniently to reduce the packaging volume of the suction cleaner.

The Chinese Patent Application No. 201220121228.2 disclosed a hose fixing mechanism, which can fix the hose on the suction cleaner using a piece of bent steel wire. However, it needs multiple parts to assemble the steel wire on the suction cleaner, which results in complex structure and high cost. In addition, it is difficult to assemble and disassemble the mechanism.

SUMMARY

To resolve the existing technical problems, the present invention proposes a hose support mechanism for a suction cleaner, which is simple in structure, convenient to assemble and disassemble, and low in cost.

The main technical proposal of the present invention is as follows: A hose support mechanism for a suction cleaner that includes a machine body, wherein the hose support mechanism comprises at least one elastic support for supporting a hose, and the elastic support can generate an elastic deformation to mutually buckle with or separate from the machine body; the elastic support includes a pair of arm-shaped components, an interconnecting component that is connected with one end of the arm-shaped components, and a pair of buckling components that are extended from the other ends of the arm-shaped components; the buckling component being matched with the machine body in a detachable manner.

Further, the present invention claims the following affiliated technical proposals:

A fixing slot is formed between the elastic support and the machine body to contain the hose.

The fixing slot has an opening end and a container under the opening end; the opening is smaller than the diameter of the hose, and the width of the container is bigger than the diameter of the hose.

The interconnecting component is provided with an arc-shaped component that is connected with the arm-shaped component, and the arc-shaped component extends along the mid-perpendicular direction of the suction cleaner.

The elastic support comprises a pair of arm-shaped components, an interconnecting component that is connected with one end of the arm-shaped components, and a pair of buckling components that are extended from the other ends of the arm-shaped components.

The machine body comprises a machine head component and a dust collector; the machine head component comprises an upper cover and a lower cover that is matched with the duct collector.

The lower cover is provided with buckling slots and through holes, and buckling slots are roughly vertical to and communicated with through holes.

The arm-shaped component is matched with the buckling slots.

The buckling component is buckled with the through hole.

The lower cover is provided with a notch, and two side walls of the notch are provided with a pair of buckling holes.

The buckling component comprises a hook and a supporting segment that is connected between the hook and the arm-shaped component.

The hook is buckled with the buckling hole.

The notch has a bottom side, on which the supporting segment is propped.

A clamping hole is formed between the upper cover and the lower cover, one of the buckling components is buckled in the clamping hole.

A locating pole and a guide plate connected with the locating pole are provided in the clamping hole.

The buckling component comprises a hook and a supporting segment that is connected between the hook and the arm-shaped component.

The buckling component is matched with the locating pole.

The supporting segment is matched with the guide plate.

The lower cover is provided with an embossment pole, a pressing cap that is fixedly pressed on the top of the embossment pole, and a wall; a buckling slot is formed among the embossment pole, the pressing cap and the wall; the other one of the pair of buckling components is buckled in the buckling slot.

The embossment pole is provided with a guide plate to guide the buckling component, and the guide plate and the embossment pole is made into one piece.

At least two fixing bases are provided on the wall of the dust collector, the elastic support is buckled with the fixing bases.

A pair of buckling slots are provided on two sides of the fixing bases to respectively buckle with the pair of buckling components.

The fixing base is provided with an arc-shaped contact surface to support the hose, and the contact surface is provided with antiskid ribs.

The beneficial technical effect of the present invention is as follows: in the present invention, the elastic support is assembled on the machine body of the suction cleaner to support the hose on the suction cleaner, and the hose support mechanism can be assembled and disassembled conveniently without using other tools, and can be adapted for hoses with different hose diameters. When the suction cleaner is provided with the hoses with different hose diameters, there is no need to redesign the hose support mechanism, thereby enhancing the generality of the suction cleaner.

DETAILED DESCRIPTION OF THE PREFERRED EMBODIMENTS

The following is a detailed description of the present invention in combination with drawings.

Embodiment 1

Figure 1:
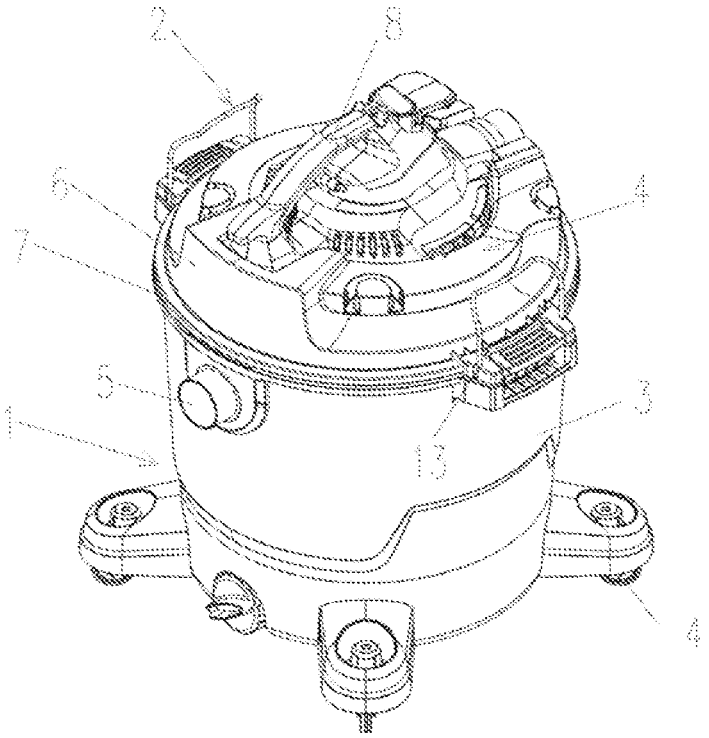
FIG. 1 is a schematic diagram of assembling the suction cleaner for Embodiment One of the present invention.

As shown in FIG. 1, a suction cleaner (i.e., a vacuum cleaner) comprises a machine body 1 and a hose support mechanism 2 matched with the machine body 1; the hose support mechanism 2 is used to enwind and support the hose (not shown in the figure) on the machine body 1. The machine body 1 comprises a dust collector 3 and a machine head component 4 matched with the dust collector 3. The dust collector 3 is used to collect waste that is sucked inside of the suction cleaner through a suction opening 5. The machine head component 4 comprises an upper cover 6 and a lower cover 7 that are matched with each other, and a motor (not shown in the figure) provided between the upper cover 6 and the lower cover 7, and the lower cover 7 is matched with the dust collector 3. A handle 8 is provided on the upper cover 6 for users to move the suction cleaner. Generally, this kind of suction cleaner is provided with a hose which is matched with the suction opening 5 through a connector.

Figure 2:
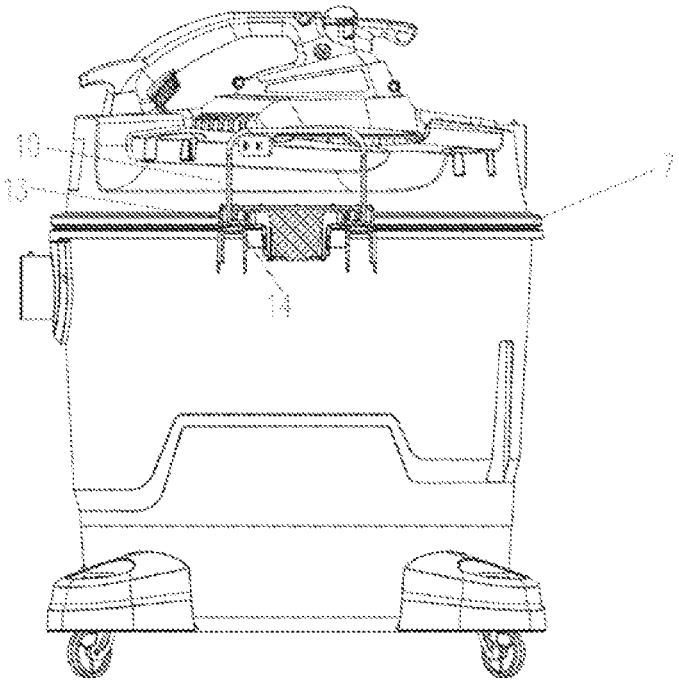
FIG. 2 is a section view of the hose support mechanism of the suction cleaner in FIG. 1.
Figure 3:
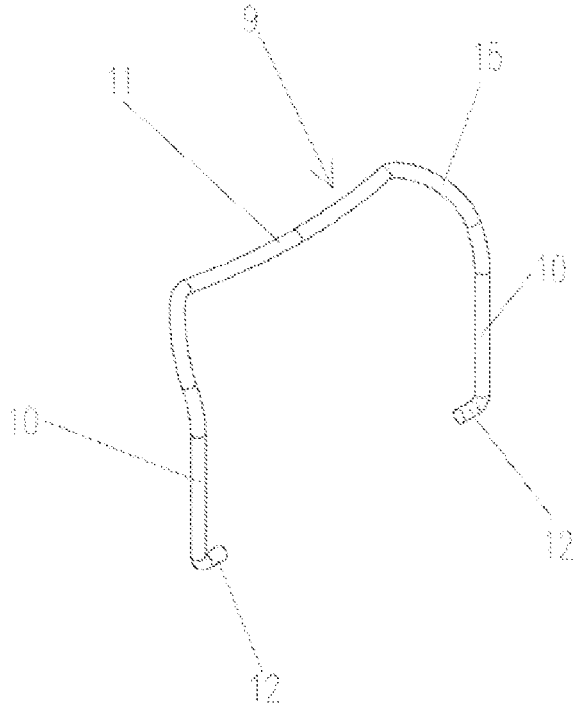
FIG. 3 is a schematic diagram of the elastic support in FIG. 2.
Figure 4:
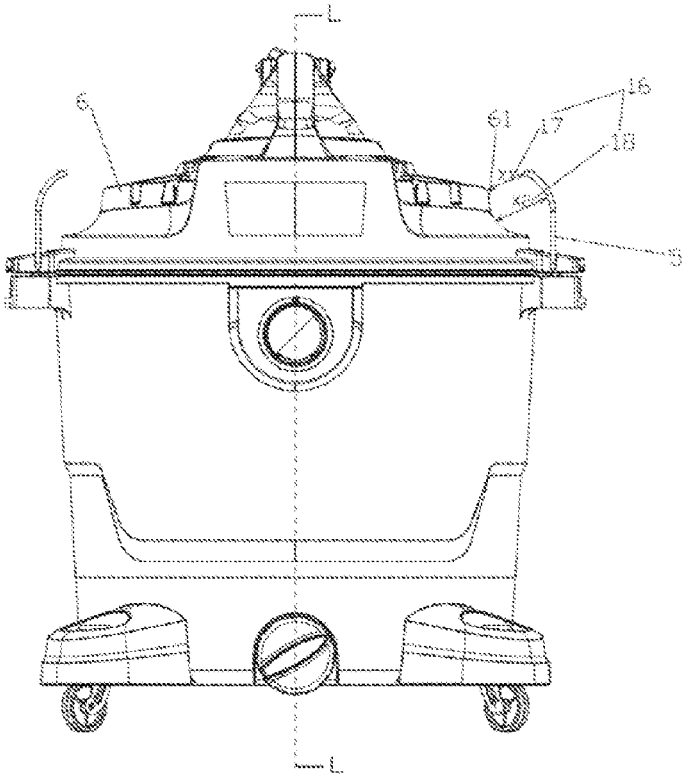
FIG. 4 is a lateral view of FIG. 1.

Further, as shown in FIGS. 2-4, the hose support mechanism 2 comprises at least one elastic support 9 for supporting the hose, and the elastic support 9 can generate an elastic deformation to mutually buckle with or separate from the machine body 1. For a preferable embodiment of the present invention, there is a pair of the elastic support 9 provided on the two circumferentially opposite sides of the machine body 1. The elastic support 9 is made of elastic metal or plastics; for a preferable embodiment of the present invention, it is a U-shaped steel wire. The elastic support 9 comprises a pair of arm-shaped components 10, an interconnecting component 11 that is connected with one end of the arm-shaped components 10, and a pair of buckling components 12 that are extended from the other ends of the arm-shaped components 10. The buckling component 12 is hook-shaped and roughly perpendicular to the arm-shaped components 10.

The elastic support 9 is mutually matched with the lower cover 7. The lower cover 7 is provided with a pair of buckling slots 13 and a pair of through holes 14 corresponding to the buckling slots 13, and buckling slots 13 are roughly perpendicular to and communicated with through holes 14. The arm-shaped components 10 of the elastic support 9 are matched with the clamping slots 13 to stop and locate the elastic support 9. A pair of buckling components 12 are buckled with the corresponding through holes 14 to form an interference fit, so as to fix the elastic support 9 on the lower cover 7.

In addition, the interconnecting component 11 of the elastic support 9 is provided with an arc-shaped component 15 that is connected with the arm-shaped component 10, and the arc-shaped component 15 extends towards the inclined upper direction along the mid-perpendicular direction L of the suction cleaner. As a result, a fixing slot 16 is formed between the elastic support 9 and the machine body 4 to contain the hose, and the fixing slot 16 has an opening end 17 and a container 18 under the opening end 17. If the diameter of the hose is defined as X, the opening distance X1 of the opening end 17 is smaller than the diameter X. The container 18 is roughly formed between the arc-shaped component 15 and arc-shaped circumstance of the upper cover 6 to contain and contact the hose, and the width X2 of the container 18 is bigger than the diameter of the hose, so as to maintain the hose inside of the fixing slot 16 and to prevent the hose from being deformed by the elastic support 9.

The support mechanism 2 is provided on the machine head component 4, so the hose can be enwound on the machine head component 4, and then can be contained and fixed within the fixing slot 16. Further, the elastic support 9 keeps the hose on the machine head component 4 and remains un-deformed because of its own elasticity. When it is necessary to disassemble the support 9, the user only needs to hold and separate the arm-shaped components 10 so that the support 9 can be separated from the suction cleaner. Thus the hose support 9 can be assembled and disassembled conveniently without using other tools or impacting use of the suction cleaner.

It must be noted that, the key point that the following four embodiments disclose is the different fixing methods and installation places for the elastic support and machine body, so as to better support the subject that the present invention protects, while the suction cleaner machine body, the elastic support, and the fixing slot formed between the elastic support and the machine body are roughly same as or similar to each other; therefore, the detailed description is omitted, and they are marked by same numbers where necessary.

Embodiment 2

Figure 5:
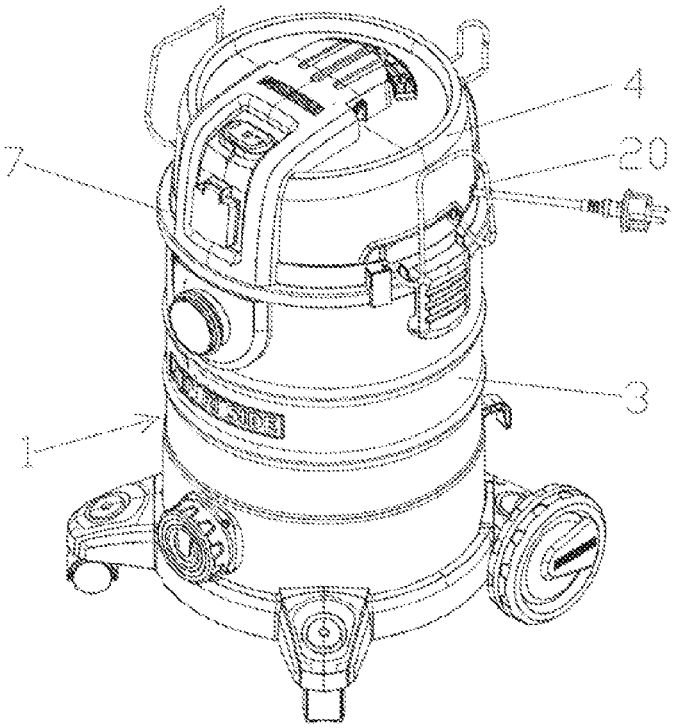
FIG. 5 is a schematic diagram of assembling the suction cleaner for Embodiment Two of the present invention.
Figure 6:
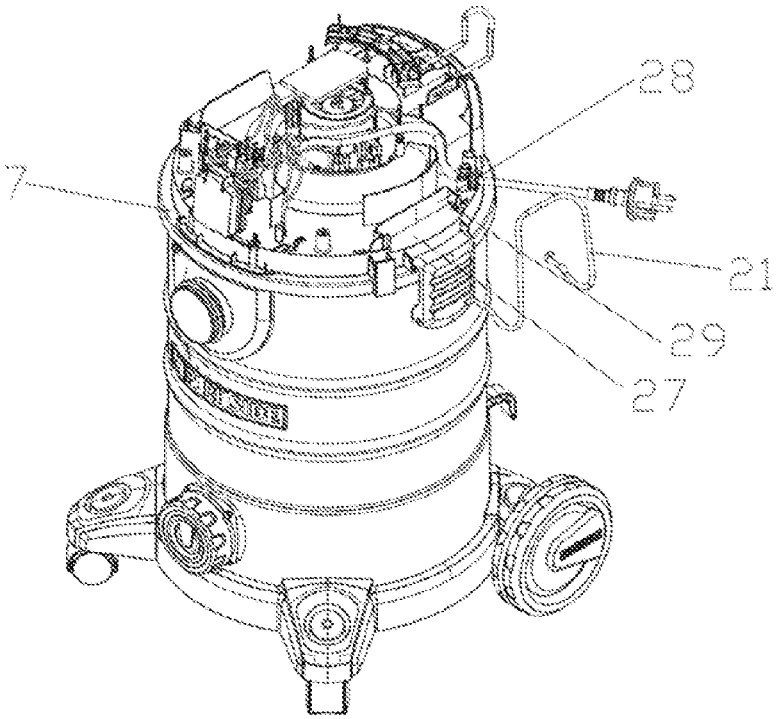
FIG. 6 is a local exploded view of FIG. 5.
Figure 7:
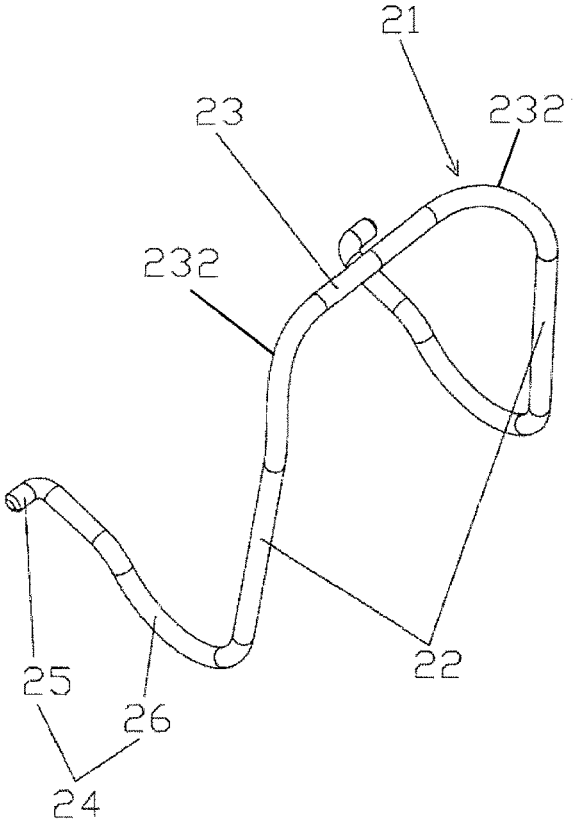
FIG. 7 is a schematic diagram of the elastic support in FIG. 5.
Figure 8:
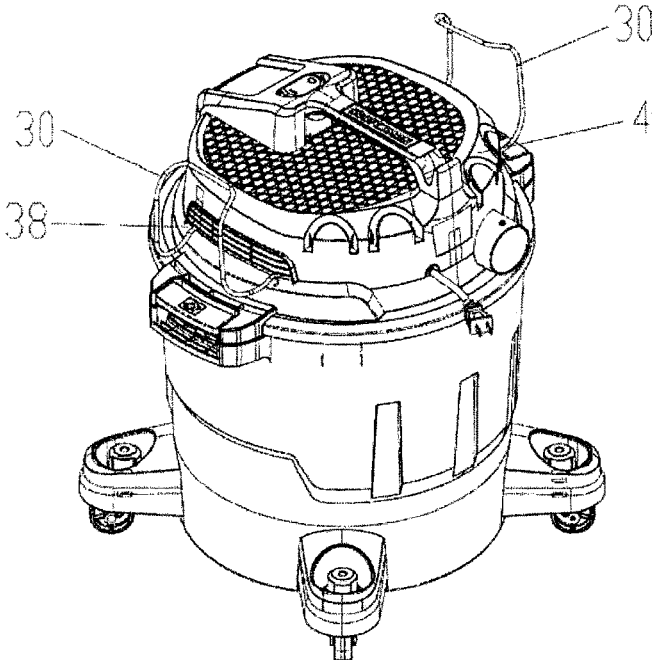
FIG. 8 is a schematic diagram of assembling the suction cleaner for Embodiment Three of the present invention.
Figure 9:
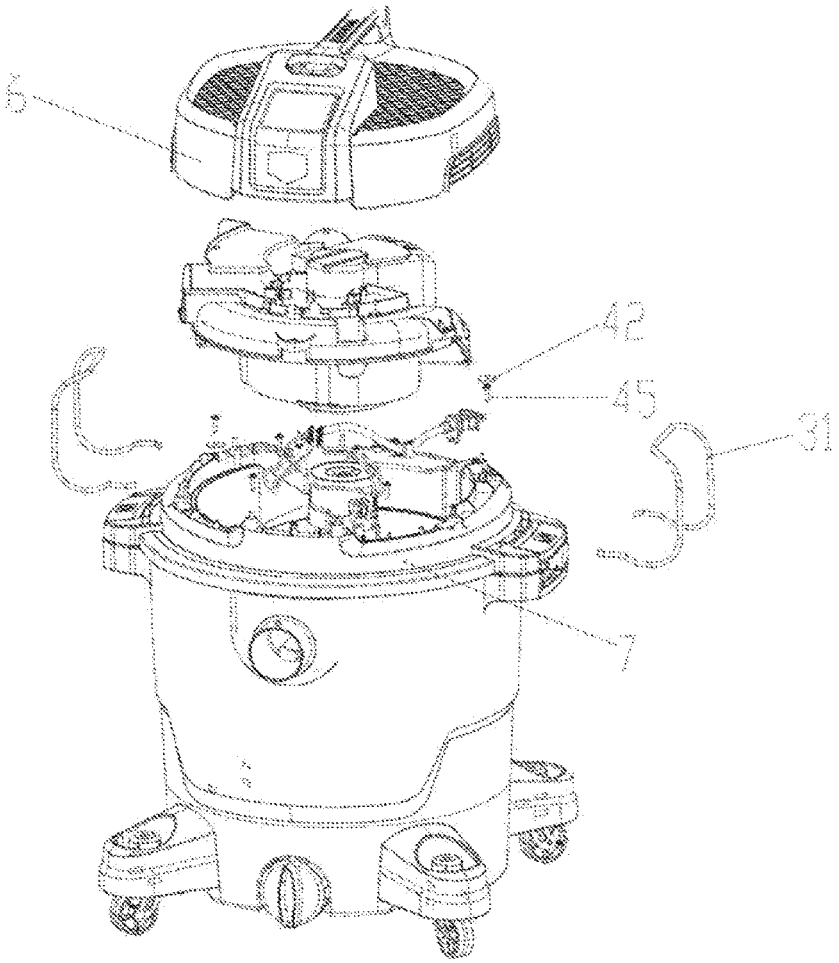
FIG. 9 is an exploded view of FIG. 8.
Figure 10:
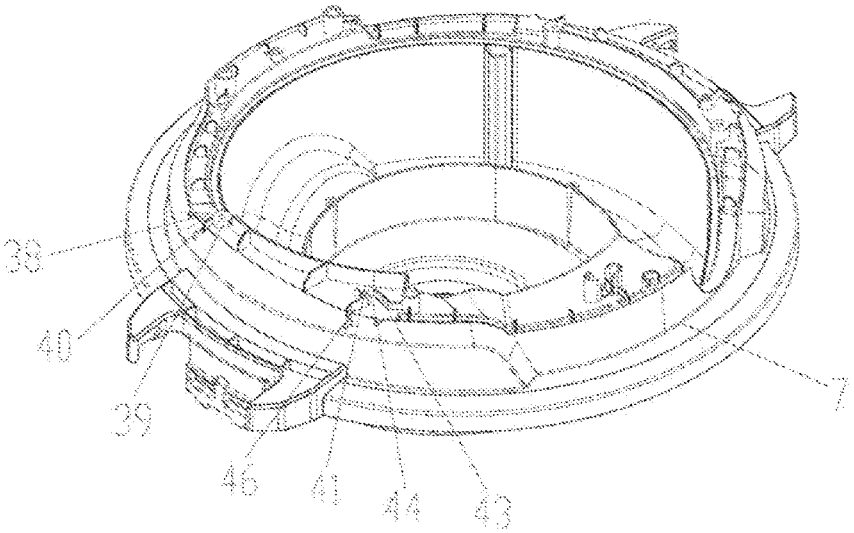
FIG. 10 is a schematic diagram of the lower cover of FIG. 9.
Figure 11:
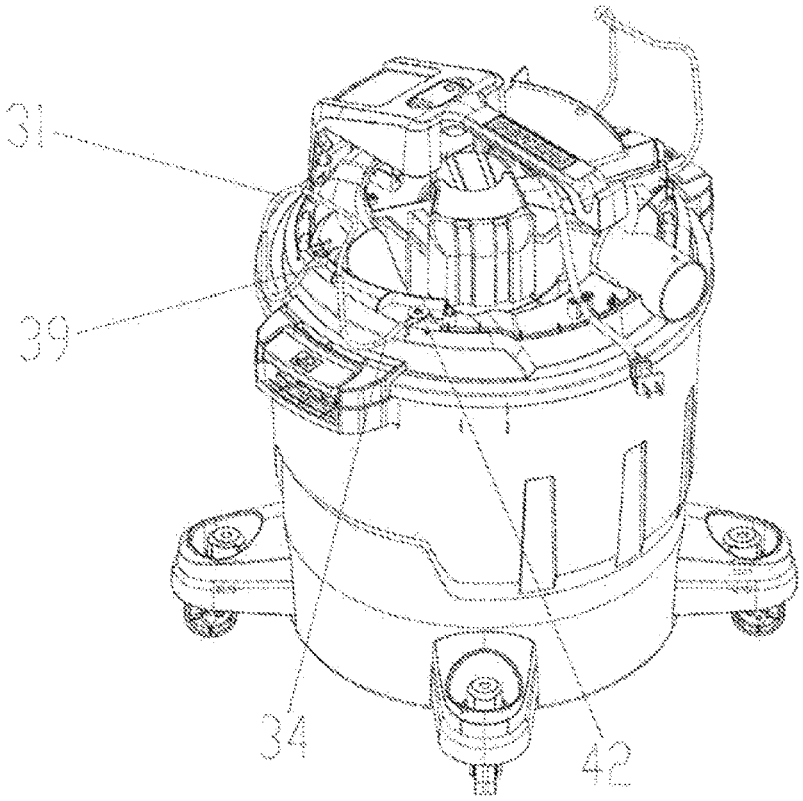
FIG. 11 is a partial assembling diagram of FIG. 9.
Figure 12:
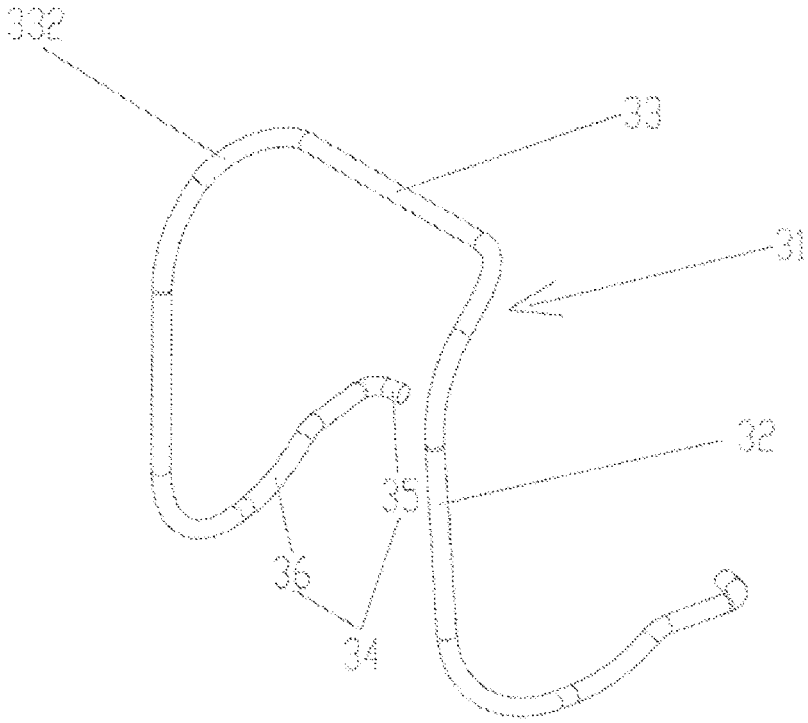
FIG. 12 is a schematic diagram of the elastic support of FIG. 9.
Figure 13:
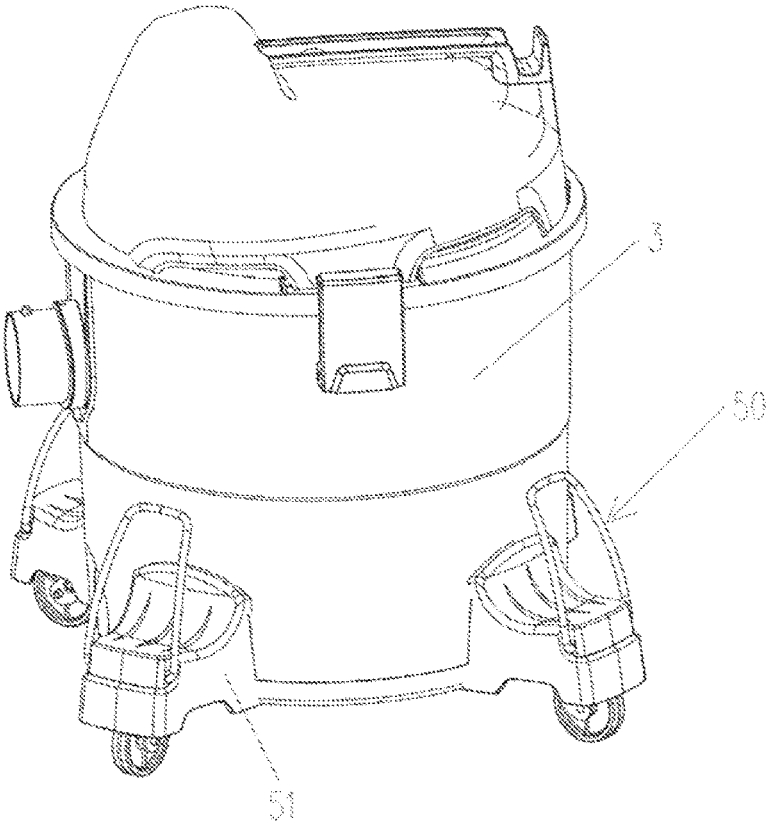
FIG. 13 is a schematic diagram of assembling the suction cleaner for Embodiment Four of the present invention.
Figure 14:
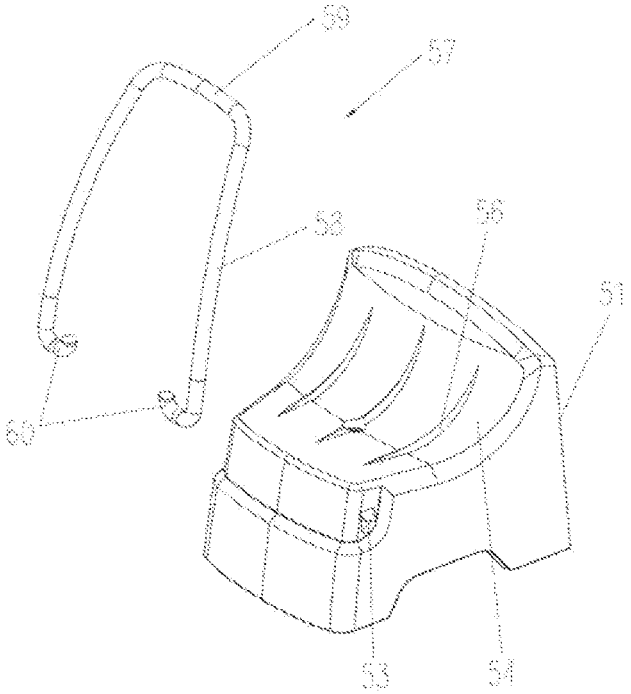
FIG. 14 is a local exploded view of FIG. 13.
Figure 15:
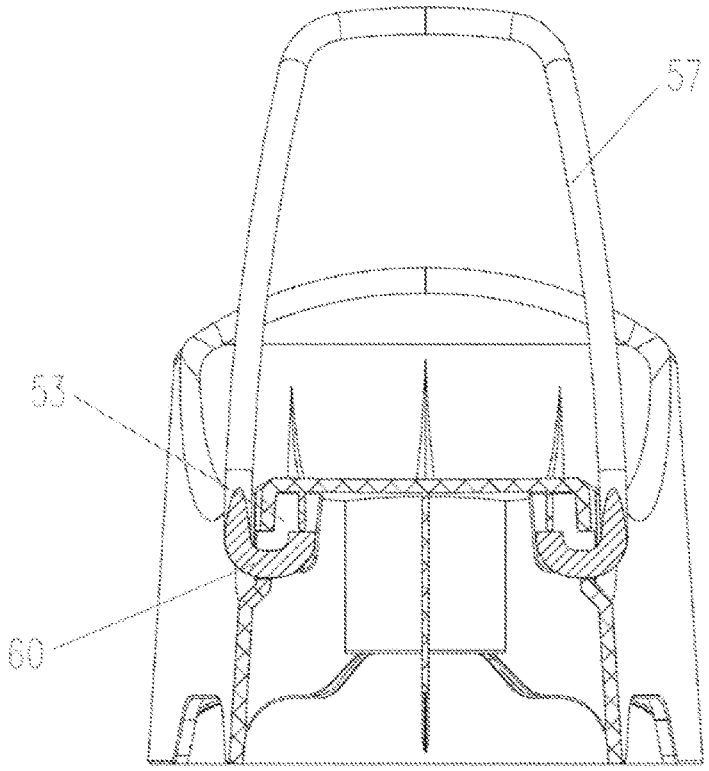
FIG. 15 is an assembling section view of FIG. 14.
Figure 16:
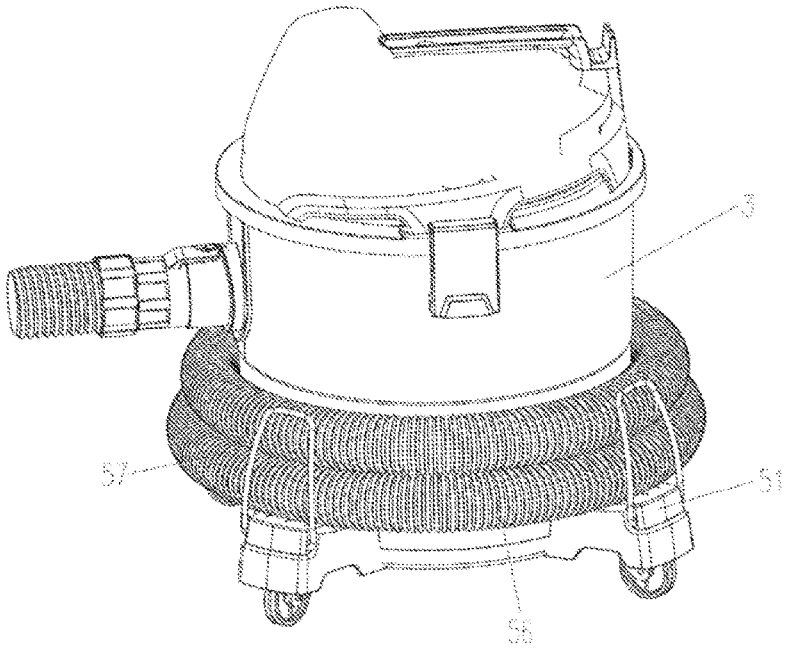
FIG. 16 is a schematic diagram after assembling the hose to the suction cleaner shown in FIG. 13.

As shown in FIGS. 5-7, the hose support mechanism 20 of the embodiment comprises a pair of elastic supports 21 that are similarly provided at the two opposite sides of the lower cover 7 of the suction cleaner. Similarly, the elastic support 21 comprises a pair of arm-shaped components 22, an interconnecting component 23 that is connected with one end of the arm-shaped components 22, and a pair of buckling components 24 that are extended from the other ends of the arm-shaped components 22. The buckling component 24 is provided with a hook 25 and a supporting segment 26 that is connected between the hook 25 and the arm-shaped component 22. The arm-shaped component 22 extends generally vertically, and the supporting segment 26 extends generally parallel, while the hook 25 extends horizontally outwards from the supporting segment 26. In addition, the interconnecting component 23 is similarly provided with arc-shaped components 232 that are connected with the arm-shaped components 22.

The lower cover 7 is circumferentially provided with a pair of notches 28 where a pair of elastic supports 21 can be assembled. Each notch 28 is provided with a buckling hole 29 on the two opposite side walls, and the buckling hole is buckled with the hook 25, and the supporting segment 26 is supported on the bottom 27 of the notch 28.

Similarly, when it is necessary to disassemble the support 21, the user only needs to hold the arm-shaped components 22 and move the pair of arm-shaped components 22 inwards to make them closer to each other, so the hooks 25 are separated from the buckling holes 29, which means the elastic support 21 is separated from the suction cleaner. As a result, the hose support 21 can be assembled and disassembled conveniently without using other tools or impacting use of the suction cleaner.

Embodiment 3

As shown in FIGS. 8-12, the hose support mechanism 30 of the embodiment comprises a pair of elastic supports 31 that are provided on the machine head component 4 of the suction cleaner. The elastic support 31 is similar to the elastic support 21 in Embodiment Two, comprising a pair of arm-shaped components 32, an interconnecting component 33 that is connected with one end of the arm-shaped components 32, and a pair of buckling components 34 that are extended from the other ends of the arm-shaped components 32. The buckling component 34 is provided with a hook 35 and a supporting segment 36 that is connected between the hook 35 and the arm-shaped component 32. The arm-shaped component 32 is extends generally vertically, and the supporting segment 36 extends generally parallel, while the hook 35 extends horizontally outwards from the supporting segment 36. In addition, the interconnecting component 33 is similarly provided with arc-shaped components 332 that are connected with the arm-shaped components 32.

A clamping hole 38 is formed between the upper cover 6 and the lower cover 7 of the machine head component 4, and one of the buckling components 34 is buckled in the clamping hole 38. A locating pole 39 and a guide plate 40 connected with the locating pole 39 are provided in the clamping hole 38. The hook 35 is matched with the locating pole 39, and the supporting segment 36 is matched with the guide plate 40, so as to buckle with the clamping hole 38 through guidance of the guide plate 40, and hook the hook 35 on the locating pole 39. In addition, the lower cover 7 is provided with an embossment pole 41, a pressing cap 42 that is fixedly pressed on the top of the embossment pole 41, and a wall 43; a buckling slot 44 is formed among the embossment pole 41, the pressing cap 42 and the wall 43; the other one of the pair of buckling components 34 is buckled in the buckling slot 44. The pressing cap 42 is fastened with the embossment pole 41 through bolts 45. Besides, the embossment pole 41 is provided with a guide plate 46 to guide the buckling component 34, and the guide plate and the embossment pole is made into one piece.

Similar to the above embodiments, the hose is supported on the machine head component 4 through the hose support mechanism 30 of the embodiment. The method to disassemble the elastic support 31 is similar to Embodiment One. It is only necessary to hold and separate the arm-shaped components 32 so that the support 31 can be separated from the suction cleaner. As a result, the hose support 31 can be assembled and disassembled conveniently without using other tools or impacting use of the suction cleaner.

Embodiment 4

As shown in FIGS. 13-17, the hose support mechanism 50 of the embodiment is provided on the circumferential wall of the dust collector 3 of the suction cleaner. Specifically, the bottom of the dust collector 3 is fixedly provided with multiple fixing bases 51. Persons skilled in the art can understand that the fixing bases 51 can be matched with other components at the bottom of the suction cleaner, for example, collector base and so on, and the fixing base can be made into one piece with these components. A pair of buckling slots 53 are provided on two sides of each fixing base 51 at the top, and the top of the fixing base 51 is an arc-shaped contact surface 54 to support the hose 55. The arc-shaped contact surface 54 is provided with multiple antiskid ribs 56 to stop the hose 55 from skidding along the section, so as to prevent the hose from loosening after being contained inside. The hose support mechanism 50 comprises multiple elastic supports 57 corresponding to the number of the fixing bases 51. The elastic support 57, which is similar to the shape of the elastic support 9 in Embodiment One, is a piece of U-shaped steel wire and comprises a pair of arm-shaped components 58, an interconnecting component 59 that connects the top ends of the arm-shaped components 58, and a pair of buckling components 60 that are extended from the other ends of the arm-shaped components 58. The buckling component 60 is an arc-shaped hook that is bucked with the corresponding clamping slot 53.

Figure 17:
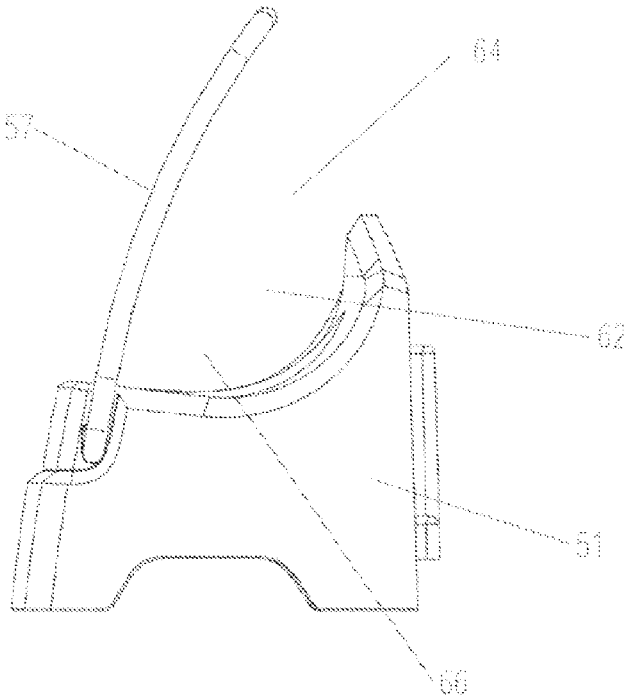
FIG. 17 is an assembling schematic diagram of FIG. 14.

In addition, as shown in FIG. 17, different from the fixing slot in above embodiments, the fixing slot 62 in this embodiment is formed by the elastic support 57 and the fixing bases 51 that are provided on the dust collector 3. The fixing slot is also U-shaped, and the opening of the opening end 64 is smaller than diameter of the hose, while the wide of bottom is bigger than diameter of the hose; as a result, the hose contained in the fixing slot 62 is prevented from skidding outside of the opening end, and the hose is also prevented from being deformed by the elastic support 57.

Through the hose support mechanism 50 of the embodiment, the hose is supported on the duct collector 3 of the suction cleaner. The disassembling method for the elastic support 57 is similar to that for Embodiment One, that is, the user only needs to hold and separate the arm-shaped component 58 so that the support 57 can be separated from the suction cleaner. Thus the hose support 57 can be assembled and disassembled conveniently without using other tools or impacting use of the suction cleaner. Further, the hose is supported on the bottom of the suction cleaner, so the center of gravity is lowered and the suction cleaner is not easy to fall over when the user moves the suction cleaner.

Embodiment 5

Figure 18:
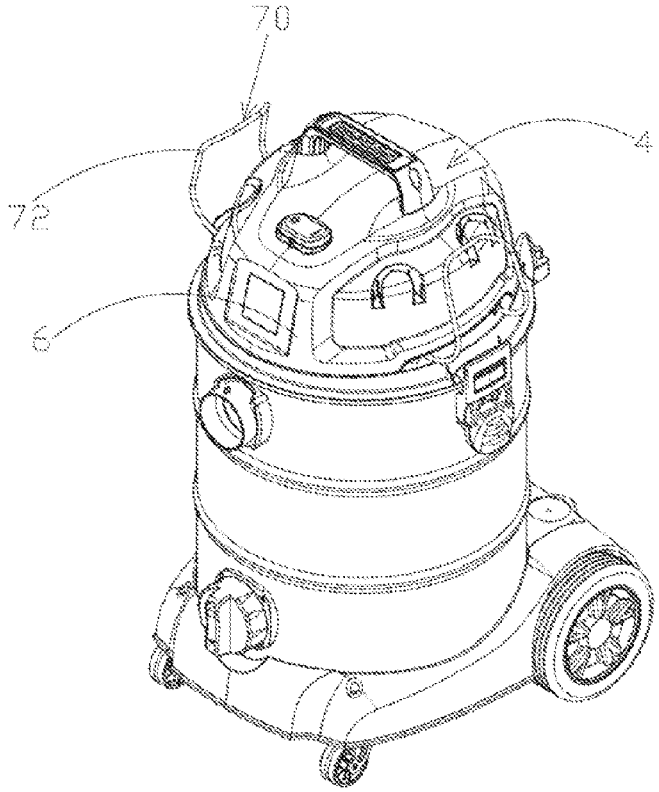
FIG. 18 is a schematic diagram of assembling the suction cleaner for Embodiment Five of the present invention.
Figure 19:
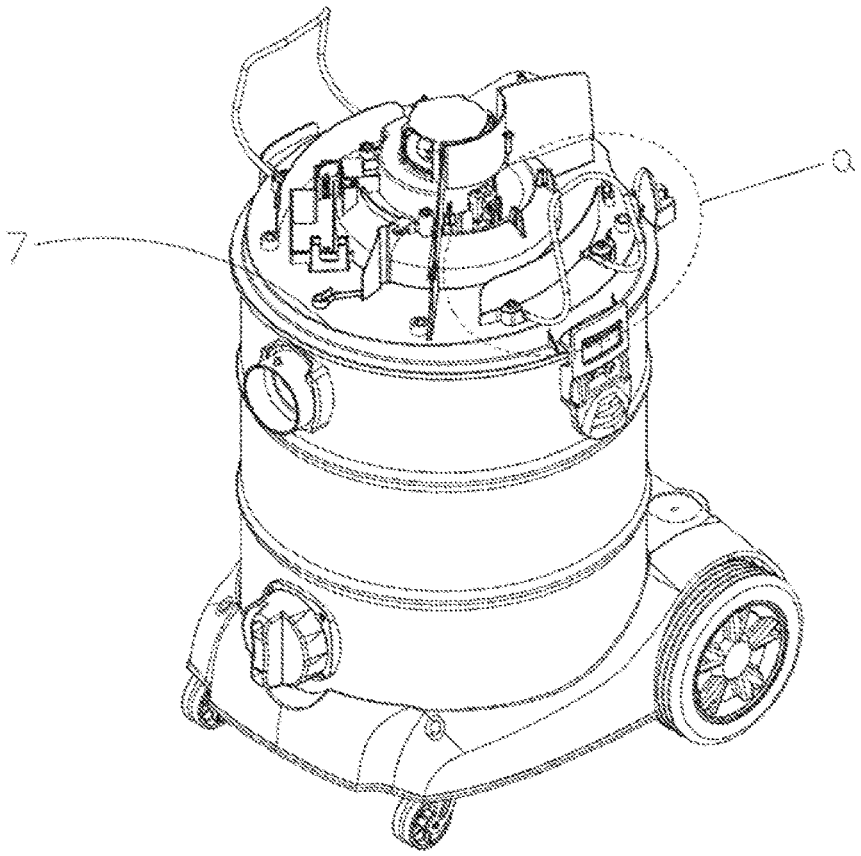
FIG. 19 is a partial assembling schematic diagram of FIG. 18.
Figure 20:
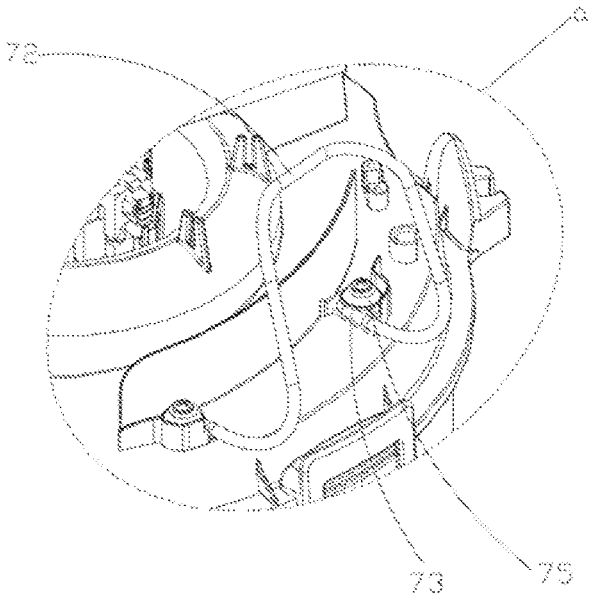
FIG. 20 is an enlarged view of the circle a in FIG. 19.

As shown in FIGS. 18-20, the hose support mechanism 70 of the embodiment is provided on the lower cover 7 of the machine head component 4 of the suction cleaner. The hose support mechanism 70 comprises a pair of elastic supports 72 that are similar to the elastic supports 31 in Embodiment Three, and a pair of buckling components 73 is buckled with the lower cover 7 of the suction cleaner through a pressing cap 75; the pressing cap 75 is fixed in the same way as that for the pressing cap in Embodiment Three, while the methods for assembling and disassembling the elastic support 72 are similar to that for Embodiment Three, so the detailed description is omitted here.

In conclusion, the hose support mechanism for suction cleaner disclosed in the present invention is simple in structure, convenient to assemble and disassemble without using other tools; and the hose support mechanism can be adapted for hoses with different hose diameters. When the suction cleaner is provided with the hoses with different hose diameters, there is no need to redesign the hose support mechanism, thereby enhancing the generality of the suction cleaner.

It must be noted that the above embodiments are supposed to explain the technical concept and feature of the present invention, so that persons who are familiar with the technique can understand and implement the present invention. However, the embodiments above do not restrict the protective scope of the present invention. All equivalent changes or modifications based on the technical concept of the present invention shall be within the scope of the present invention.

The invention claimed is:

1. A hose support mechanism for a vacuum cleaner having a machine body and a hose, the machine body including a machine head component and a dust collector, the machine head component including an upper cover and a lower cover attachable to the duct collector, the lower cover including two buckling slots, a through hole being defined through the lower cover adjacent each buckling slot, and the buckling slots being generally perpendicular to and in communication with each through hole, the hose support mechanism comprising:

an elastic support for supporting the hose, the elastic support configured to elastically deform so as to mutually buckle with or separate from the machine body, the elastic support including a pair of arm-shaped components, an interconnecting component that is connected with one end of the arm-shaped components, and a pair of buckling components that respectively extend substantially coaxially and towards each other at a first distance smaller than a second distance between the through holes from other ends of the arm-shaped component, the buckling components sized for receipt in the through holes, the elastic support being configured to be sufficiently elastically deformable so that the elastic support is attachable to the machine body in a detachable manner by deflecting the other ends of the arm-shaped components outwardly so that the buckling components are separated by a distance at least as large as the second distance and distal ends of the buckling components may be inserted into the through holes.

2. The hose support mechanism for a vacuum cleaner according to claim 1, wherein a fixing slot is formed between the elastic support and the machine body to contain the hose.

3. The hose support mechanism for a vacuum cleaner according to claim 2, wherein the fixing slot has an opening end and a container under the opening end, the opening end being smaller than a diameter of the hose, and a width of the container being bigger than the diameter of the hose.

4. The hose support mechanism for a vacuum cleaner according to claim 2, wherein the interconnecting component includes an arc-shaped component connected with the arm-shaped component, and the arc-shaped component extends along the mid-perpendicular direction of the vacuum cleaner.

5. The hose support mechanism for a vacuum cleaner according to claim 1, wherein each arm-shaped component is matched with a respective one of the buckling slots.

* * * * *